US006139355A

United States Patent [19]

Puerner

[11] Patent Number: 6,139,355

[45] **Date of Patent: *Oct. 31, 2000**

[54] COVER AND STRAIN RELIEF FOR A CABLE ASSEMBLY

[75] Inventor: Dean Arnold Puerner, Maricopa, Ark.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/080,845

[22] Filed: May 18, 1998

[51] Int. Cl.[7] ..... H01R 13/58

[52] U.S. Cl. ..... 439/473; 439/468

[58] Field of Search ..... 439/473, 468, 439/469, 470, 472

[56] References Cited

U.S. PATENT DOCUMENTS

| | | | |
|---|---|---|---|
| 4,130,330 | 12/1978 | Chandler | 339/75 M |
| 4,408,819 | 10/1983 | Guelden . | |
| 4,516,822 | 5/1985 | Wolfel | 339/103 M |
| 4,722,580 | 2/1988 | Kocher et al. | 439/466 |
| 4,749,369 | 6/1988 | Wang | 439/459 |
| 4,781,330 | 11/1988 | Atkins | 439/359 |
| 5,445,538 | 8/1995 | Rodrigues et al. | 439/460 |
| 5,580,271 | 12/1996 | Buchheister, Jr. et al. | 439/493 |
| 5,897,392 | 4/1999 | Takahashi et al. | 439/470 |

*Primary Examiner*—Paula Bradley
*Assistant Examiner*—Katrina Davis

[57] ABSTRACT

A cover (8) and strain relief for an electrical cable assembly (1) has a clamping member (11) adjustable in position to clamp against a cable (3) in an opening (9) through the cover (8), an expansible portion (13) of the cover (8) being expansible to fit substantially around an electrical connector (2) terminated to the cable (3), and the clamping member (11) holding onto the expansible portion (13) to resist its expansion away from being substantially around the connector (2).

14 Claims, 4 Drawing Sheets

COVER AND STRAIN RELIEF FOR A CABLE ASSEMBLY

FIELD OF THE INVENTION

The invention relates to a cover for an electrical connector that terminates an electrical cable, and a strain relief for the electrical cable of a cable assembly.

BACKGROUND OF THE INVENTION

According to U.S. Pat. No. 4,722,580, a known cable assembly comprises, an electrical cable, and an electrical connector terminating the electrical cable, for example, by the connector having electrical contacts electrically connected to corresponding electrical conductors of the cable. A cover of bipartite construction encircles the connector and the cable. A strain relief on the cover adjustably tightens onto the cable to resist tension and bending forces that are applied to the cable.

In the known cable assembly, the cover is of bipartite construction for ease of assembly to the connector. A one piece cover would desirably reduce the number of component parts, and would reduce the cost of manufacturing a bipartite cover. However, a one piece cover would be difficult to fit onto an exterior of an electrical connector, particularly if dimensional tolerances would provide a loose fit between the cover and the connector. Thus, a need exists for a cover that is easily assembled to a connector, the cover further being capable of being fit substantially to an exterior of the connector without a need for a cover of multiple parts.

SUMMARY OF THE INVENTION

The invention relates to a cover and strain relief, and to a cable assembly having the cover and strain relief. The cover is easily assembled substantially around and against a connector of the cable assembly. And the strain relief for the cable of the cable assembly holds onto the cover to resist its expansion away from being fit substantially against the connector.

DESCRIPTION OF THE DRAWINGS

An embodiment of the invention will now be described by way of example with reference to the drawings, according to which.

DETAILED DESCRIPTION

Figure 8:
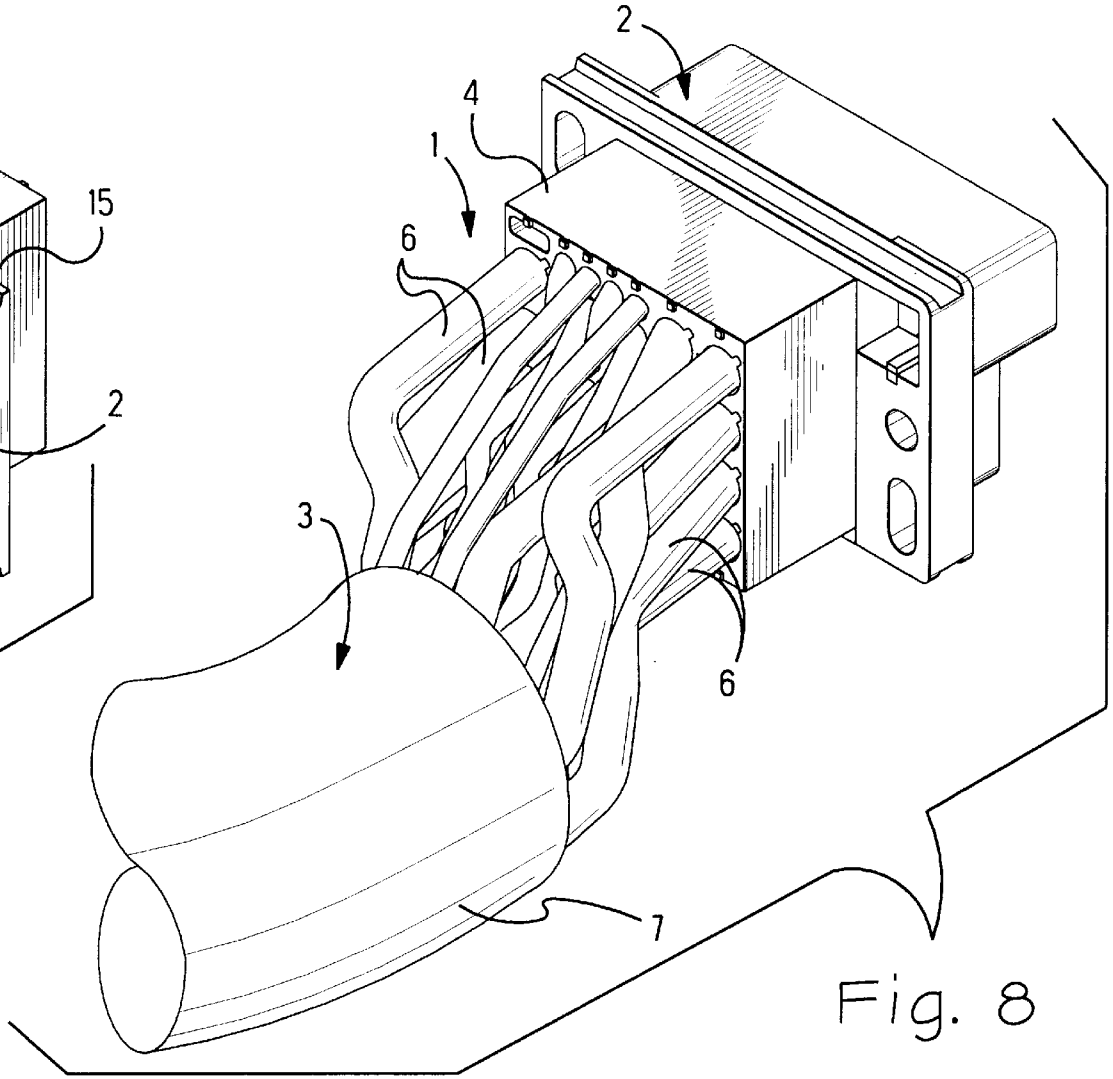
FIG. 8 is an isometric view of a cable assembly.
Figure 7:
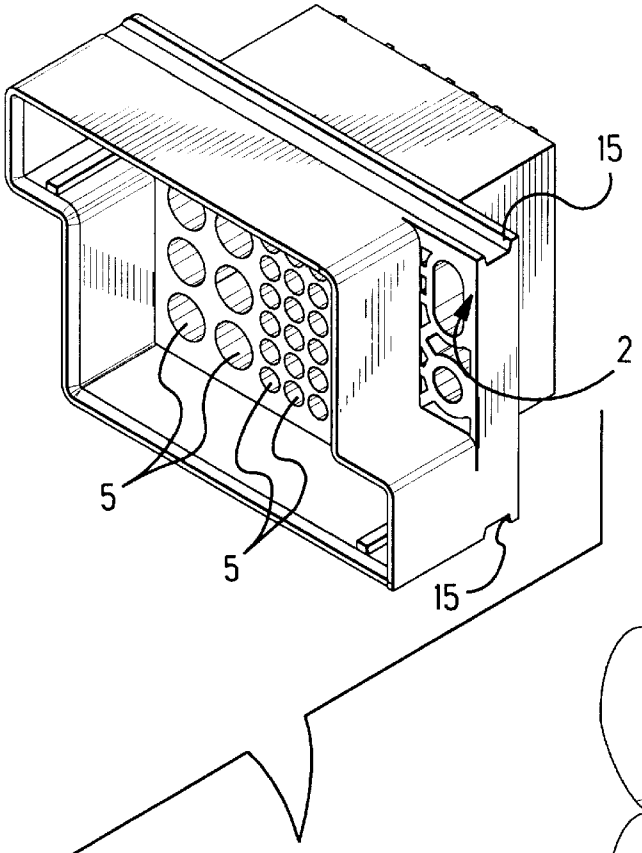
FIG. 7 is an isometric view of an electrical connector of a cable assembly, as shown in FIG. 8.

With reference to FIGS. 7 and 8, a cable assembly 1 comprises, an electrical connector 2 terminating an electrical cable 3. The connector 2 comprises an insulating housing 4, and contact receiving cavities 5 through the housing 4, FIG. 7, and electrical contacts, not shown, in the cavities 5 being electrically connected to corresponding, insulated electrical conductors 6, FIG. 8, extending from an interior of a jacket 7 on the cable 3. Further details of the cable assembly 1 are disclosed, for example, in U.S. Pat. No. 5,580,271, incorporated herein by reference.

Figure 2:
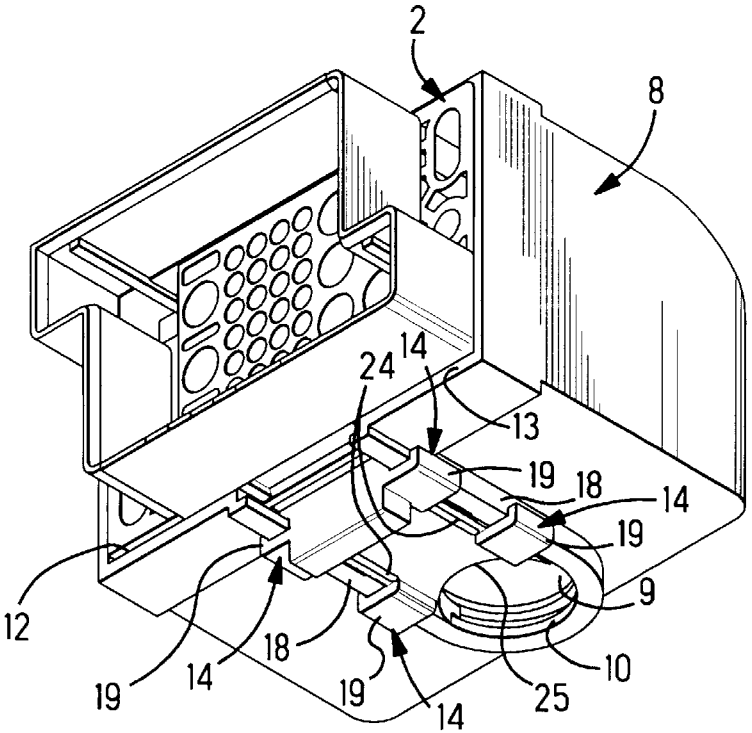
FIG. 2 is a view similar to FIG. 1 with the parts assembled, together with an electrical connector.
Figure 1:
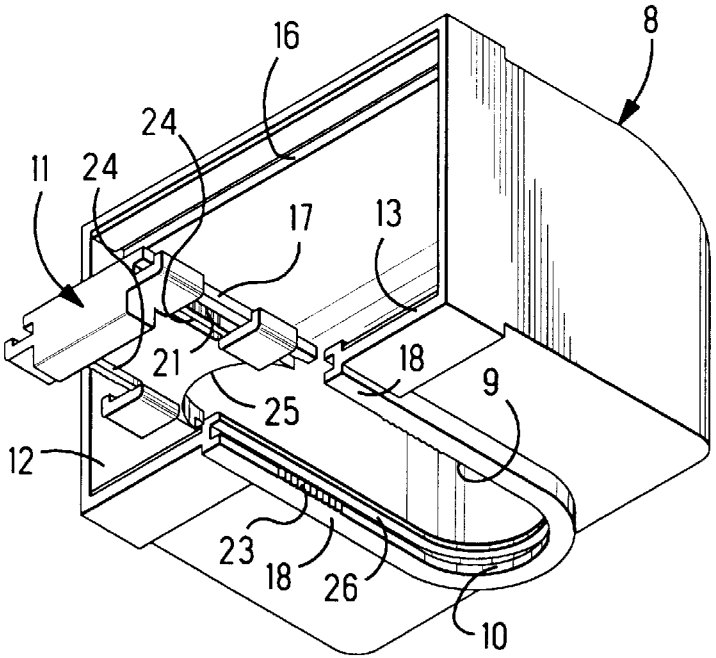
FIG. 1 is an isometric view of a cover and a strain relief for an electrical cable assembly, with parts separated from one another.
Figure 3:
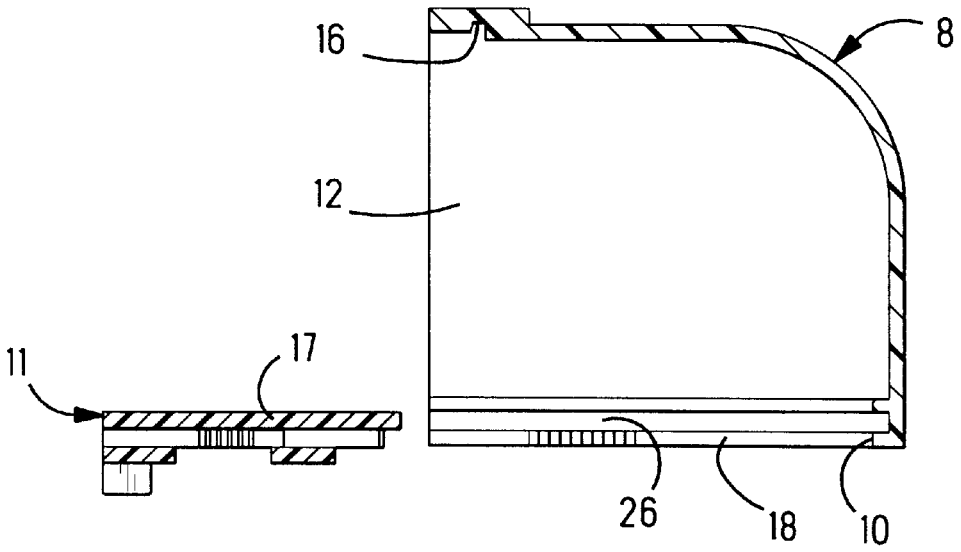
FIG. 3 is a section view taken along the line 3—3 of FIG. 4.

With reference to FIG. 1, a hollow cover 8 and a strain relief for the cable assembly 1 will now be described. The cover 8 is of one piece construction, for example, a molded insulating material receiving the connector 2, as shown in FIG. 2. The cover 8 has a cable receiving opening 9 through which the cable 3 extends, FIG. 5. The cable receiving opening 9 extends through a thin wall of the cover 8. The opening 9 is elongated, with a narrowed portion 10 at one end.

Figure 5:
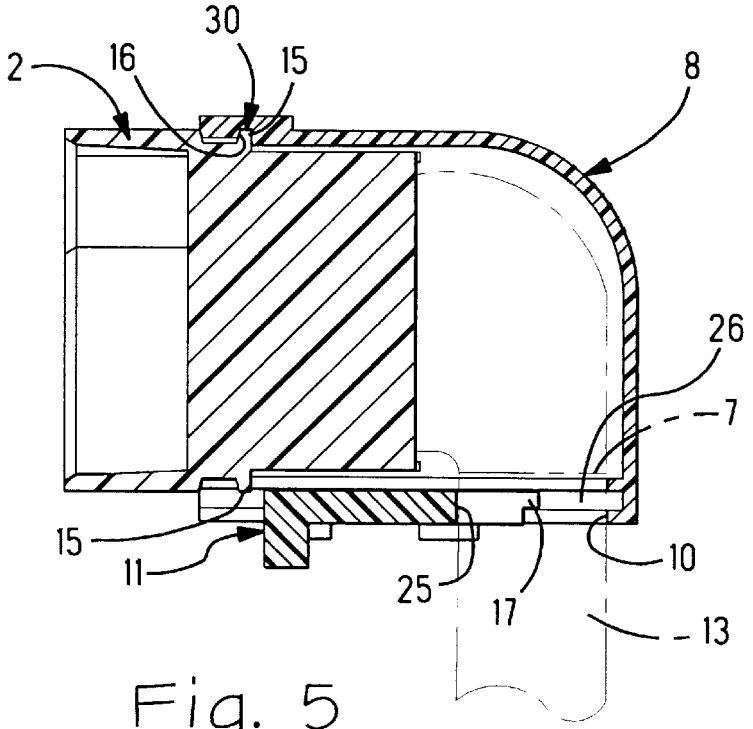
FIG. 5 is a section view taken along the line 5—5 of FIG. 6.

The strain relief is of one piece molded construction having a clamping member 11 adjustable in position to narrow the opening 9 and to clamp against the cable 3 in the narrowed portion 10 of the opening 9, FIG. 5. For example, the clamping member 11 and the narrowed portion 10 of the opening 9 clamp against the jacket 7 of the cable 3 to resist tension and bending forces that would tend to dislodge or damage the electrical connections of the cable 3 with the electrical contacts in the connector 2.

With reference to FIGS. 1 and 2, the cable receiving opening 9 opens into an open front end, or connector receiving portions 12 of the cover 8. The cover 8 has an expansible portion 13 that at least partially encircles the cover 8 at the open front end 12. When the cover 8 is assembled over the cable assembly 1, the connector 2 is inserted into the open front end 12, FIG. 2, which allows the cable 3 to extend from the housing 4, and to project through the cable receiving opening 9.

As shown in FIGS. 1 and 5, interlocking portions 30 are on the connector 2 and the expansible portion 13. The interlocking portions 30 comprise, a projecting tongue 15 encircling the exterior of the connector 2 that fits along a corresponding groove 16 on the interior of the expansible portion 13. The expansible portion 13 of the hollow cover 8 is expansible by widening the cable receiving opening 9 that is shown in FIG. 1, so as to allow passage of the connector 2 into the cover 8, until the tongue 15 registers in the groove 16, FIG. 5. Thereafter, the expansible portion 13 undergoes contraction and fits substantially around and against the connector 2, FIGS. 2 and 5. Thereafter, the clamping member 11 is assembled onto the cover 8. As shown in FIG. 2, the clamping member 11 holds onto the expansible portion 13 to resist its expansion away from being substantially against the connector 2. The clamping member bridges across the opening and holds the expansible portion to resist widening of the opening.

With reference to FIGS. 1–4, The clamping member 11 has elongated rails 17. Each of the rails 17 is slidable along a corresponding track 18 extending along opposite sides of the cable receiving opening 9. For example, the track 18 has a groove 26 that slidably receives a corresponding rail 17.

The clamping member 11 bridges across the cable receiving opening 9 to hold onto the expansible portion 13. The clamping member 11 holds onto the expansible portion 13 to resist its expansion while the interlocking portions 30 are interlocked. Securing portions 14 comprise, the corresponding track 18 extending along opposite sides of the cable receiving opening 9, and hook shaped fingers 19 on the clamping member 11 that overlap and interlock with the corresponding track 18 while the fingers 19 are slidable along the corresponding track 18.

Figure 4:
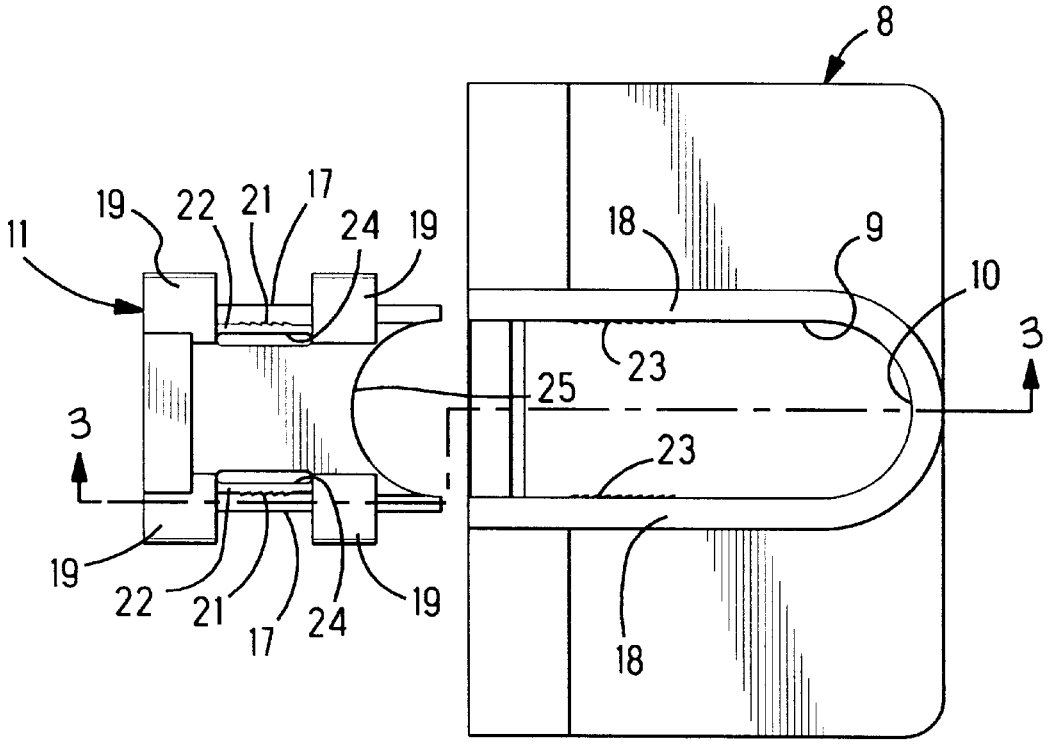
FIG. 4 is a bottom view of the cover and strain relief as shown in FIG. 1.
Figure 6:
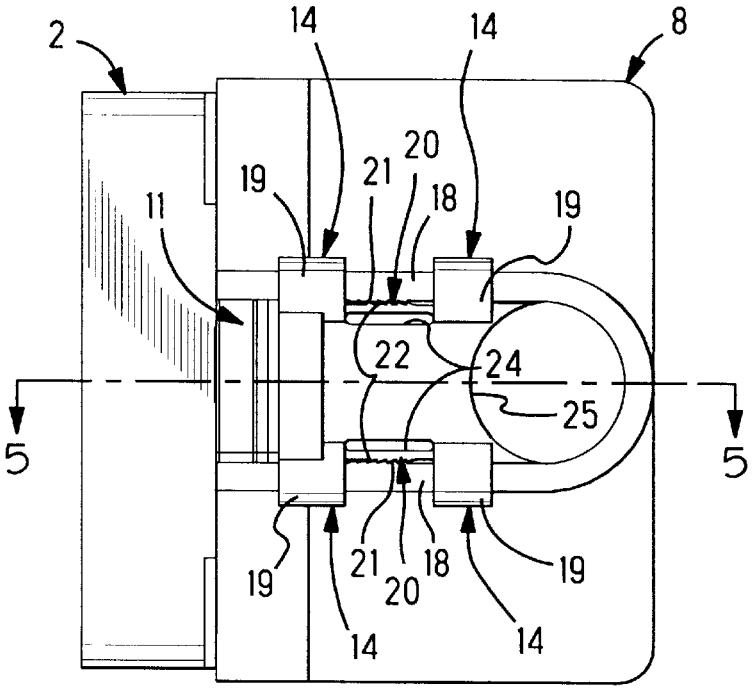
FIG. 6 is a bottom view of the parts as shown in FIG. 2.

With reference to FIGS. 1, 4 and 6, a ratchet mechanism 20 comprises ratchet teeth 21 on the clamping member 11, along resiliently deflectable, end supported, beams 22, which interengage with ratchet teeth 23 on the cover 8, along the corresponding track 18. As the clamping member 11 is adjustable in position, by ratcheted movement of the clamping member 11 along the corresponding track 18, the ratchet mechanism 20 allows ratcheted movement of the clamping member 11 along the cable receiving opening 9, toward the cable 3, and resists movement of the clamping member 11 in an opposite direction, away from the cable 3. As shown in FIGS. 4 and 6, slots 24 in the clamping member 11 are alongside the beams 22 to provide clearance spaces allowing for movement of the beams 22 in resilient deflection. The clamping member 11 has a concave clamping surface 25 that conforms to a convex exterior of the cable 3.

Other embodiments and modifications of the invention are intended to be covered by the spirit and scope of the appended claims.

What is claimed is:

1. A cover and strain relief for an electrical cable assembly comprising: an enclosure assembled over a cable assembly, the enclosure having a cable receiving opening through which a cable of the cable assembly is received, a cable strain relief having a clamping member adjustable in position to clamp against the cable, a connector receiving portion of the enclosure having an expansible portion, the connector receiving portion fitting around an electrical connector terminated to the cable, and the clamping member holding onto the expansible portion to resist expansion of the expansible portion away from the connector.

2. A cover and strain relief as recited in claim 1, wherein an interlocking portion is on the enclosure, the clamping member holds onto the expansible portion and resists its expansion while the interlocking portion interlocks with the connector.

3. A cover and strain relief as recited in claim 1, wherein the cable receiving opening extends through the expansible portion, and the clamping member bridges across the cable receiving opening to resist widening of the opening.

4. A cover and strain relief as recited in claim 1, wherein a ratchet mechanism comprises ratchet teeth on the clamping member interengaging with ratchet teeth on the enclosure as the clamping member is adjustable in position to narrow the opening and to clamp against the cable.

5. A cover and strain relief as recited in claim 1, wherein interlocking portions are on the connector and the connector receiving portion, and the clamping member holds onto the expansible portion to resist its expansion while the interlocking portions are interlocked.

6. A cover and strain relief for an electrical cable assembly comprising: a clamping member adjustable in position on an enclosure to clamp against a cable in a cable receiving opening through the enclosure, a connector receiving portion of the enclosure having an expansible portion being expansible by widening of the opening, the expansible portion being contractible such that the connector receiving portion fits substantially around an electrical connector terminated to the cable, and the clamping member holding onto the expansible portion to resist expansion of the expansible portion away from the connector by widening of the opening.

7. A cover and strain relief as recited in claim 6, wherein the opening extends through the expansible portion, the clamping member bridges a cross the opening and holds onto the expansible portion.

8. A cover and strain relief as recited in claim 6, wherein a ratchet mechanism comprises ratchet teeth on the clamping member interengaging with ratchet teeth on the enclosure as the clamping member is adjustable in position to narrow the opening and to clamp against the cable.

9. A cover and strain relief for an electrical cable assembly comprising: an enclosure having a cable receiving opening through which a cable of the cable assembly is received, a connector receiving portion of the enclosure having an expansible portion which is expansible to allow passage into the enclosure of a connector that is terminated to the cable, the expansible portion being contractible such that the connector receiving portion fits substantially around the connector, a clamping member of a strain relief being moveable along the cable receiving opening to clamp against the cable, the clamping member bridging across the cable receiving opening and holding onto the expansible portion to resist expansion of the expansible portion away from the connector.

10. A cover and strain relief as recited in claim 9, wherein the cable receiving opening opens into the open end, the expansible portion is expansible by widening of the cable receiving opening, and the clamping member bridges across the cable receiving opening and resists expansion of the expansible portion by resisting widening of the cable receiving opening.

11. A cover and strain relief as recited in claim 9, wherein a ratchet mechanism comprises ratchet teeth on the clamping member interengaging with ratchet teeth on the enclosure as the clamping member is adjustable in position to narrow the opening and to clamp against the cable.

12. A cover and strain relief as recited in claim 9, wherein the enclosure has an open front end into which the connector is inserted, and the enclosure interlocks with the connector while the clamping member holds onto the expansible portion and resists its expansion.

13. A cover and strain relief as recited in claim 12, wherein the enclosure has an open end into which the connector is inserted, the cable receiving opening opens into the open end, the clamping member is slidable along sides of the cable receiving opening, and the clamping member has securing portions which interlock with the sides to hold onto the expansible portion.

14. A cover and strain relief as recited in claim 13, wherein the sides have tracks therealong and the clamping member overlaps and interlocks with the tracks while being slidable along the tracks.

* * * * *